United States Patent [19]

Zwick

[11] Patent Number: 4,472,946

[45] Date of Patent: Sep. 25, 1984

[54] CRYOGENIC STORAGE TANK WITH BUILT-IN PUMP

[76] Inventor: Eugene B. Zwick, P.O. Box 2460, Huntington Beach, Calif. 92646

[21] Appl. No.: 462,102

[22] Filed: Jan. 28, 1983

[51] Int. Cl.[3] ..... F17C 7/02

[52] U.S. Cl. ..... 62/55; 222/383; 417/901

[58] Field of Search ..... 62/45, 49, 55; 417/901; 222/383

[56] References Cited

U.S. PATENT DOCUMENTS

| | | | |
|---|---|---|---|
| 2,888,879 | 6/1959 | Gaarder | 62/55 |
| 2,932,310 | 4/1960 | Koblish | 62/55 |
| 3,109,293 | 11/1963 | Williams et al. | 62/55 |
| 3,212,280 | 10/1965 | Thomas et al. | 62/55 |
| 3,220,202 | 11/1965 | Gottzmann | 62/55 |
| 3,276,214 | 10/1966 | Wilson et al. | 62/49 |
| 3,431,744 | 3/1969 | Veilex et al. | 62/55 |

*Primary Examiner*—Ronald C. Capossela

*Attorney, Agent, or Firm*—Beehler, Pavitt, Siegemund, Jagger & Martella

[57] ABSTRACT

A cryogenic storage tank with a built-in pump for pumping cryogen directly from the primary storage container consistent with low boil-off losses of cryogen has an outer vessel, an inner vessel and an evacuated insulation space therebetween. A pump mounting tube assembly extends into the interior of the inner vessel and includes an inner pump mounting tube and an outer pump mounting tube joined at their lower rims to define an insulating jacket between the two tubes. The inner pump mounting tube is affixed at its upper end to the outer vessel while the outer pump mounting tube is affixed at its upper end to the inner vessel. The inner pump mounting tube defines a relatively long heat path into the cryogenic container and is itself insulated from the liquid cryogen by a pocket of trapped gas formed within the inner pump mounting tube by heated cryogen. A pump may be introduced through the inner pump mounting tube and is also insulated against contact with liquid cryogen by the trapped gas such that only the lowermost end of the pump is immersed in cryogen thereby minimizing heat leakage into the tank.

12 Claims, 3 Drawing Figures

10
12
14
16
18
20
22
24
25
26
27
28
29
34
36
38
40
42
44
46
52
54
60
62
64
66
68
70
74
76
78
80
81
82
83
84
2

Fig. 2
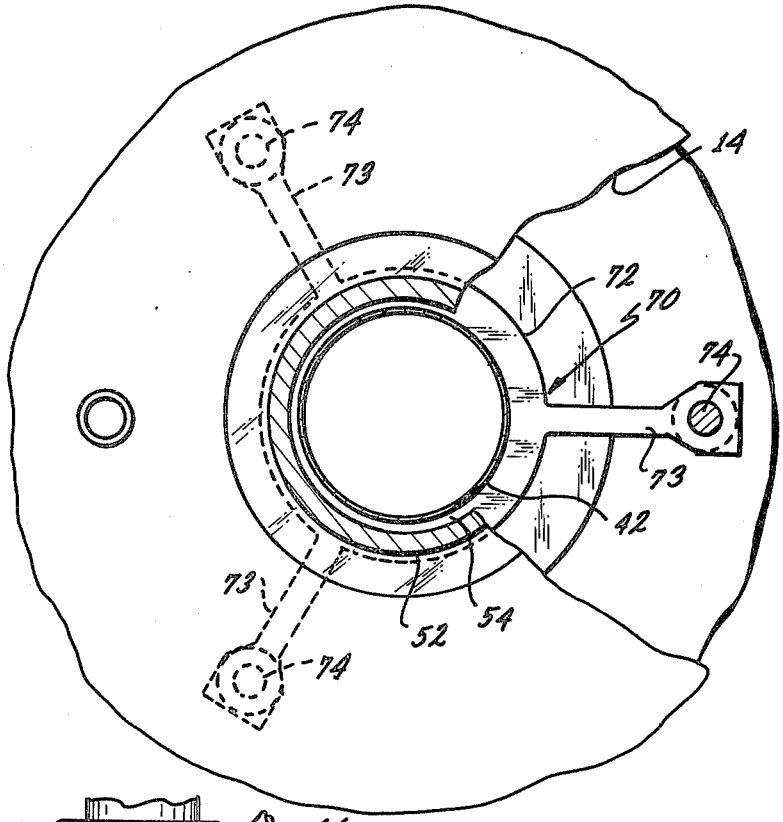
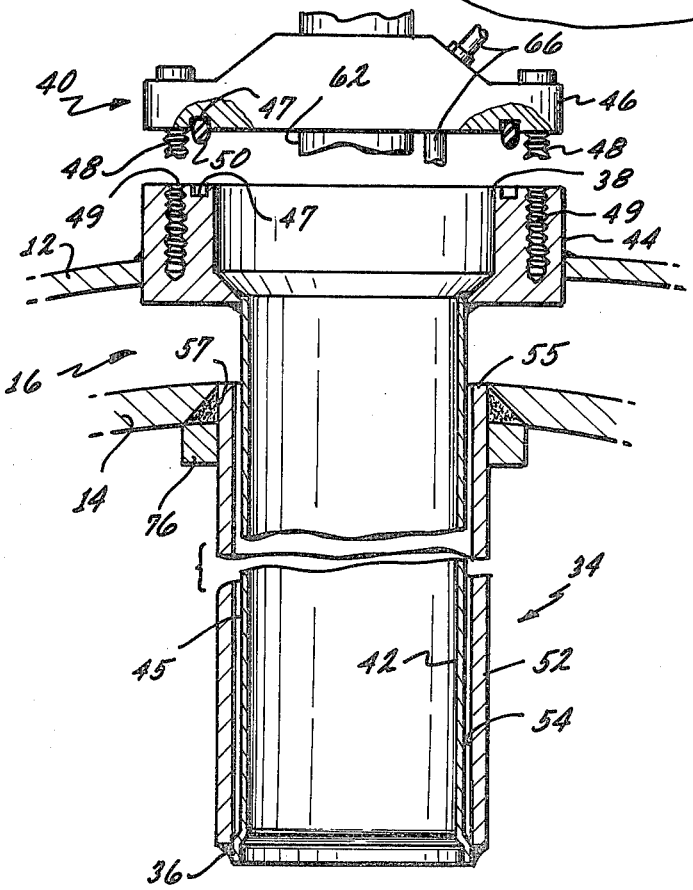
Fig. 3

CRYOGENIC STORAGE TANK WITH BUILT-IN PUMP

BACKGROUND OF THE INVENTION

1. Field of the Invention

The present invention concerns generally cryogenic storage containers and is more particularly directed to a cryogenic tank having a built-in submerged pump for pumping the cryogen directly out of the primary storage tank without a cool down period preliminary to the pumping operation.

2. State of the Prior Art

A cryogenic fluid or cryogen such as liquid nitrogen is a substance which exists in the liquid state only at very low temperatures and consequently has a very low boiling point. Because of this low boiling point, two primary considerations when designing a system for storing and pumping a cryogen are the need for adequate insulation of the storage container to minimize losses of cryogen due to "boiloff", and the need to cool down the pump to the cryogen temperature before pumping.

In order to meet the first criterion, cryogenic tanks rely on good thermal and/or radiation barriers i.e. insulation, high vacuums between container walls, and construction techniques which minimize the thermal leak paths from the exterior environment into the cryogen. Typical thermal paths in cryogenic storage systems include conduction, convection and radiation between the inner and outer shells, fluid and gas lines which connect the inner shell to the outside, supports for the inner shell of a multi-shell container, and any connection to pumps for pumping the cryogen from the primary storage tank. Due to its mass and its inevitable contact with the cryogen, a pump normally provides a high thermal leak path which in existing systems has lead to unacceptably high losses of cryogen due to boiloff.

The solution to this problem generally adopted in the past has been to locate the pump outside the primary cryogenic storage tank where the pump is normally kept at ambient temperature. However, in order to keep the cryogen in the liquid state while being pumped, the pump must be cooled down to the cryogen temperature before pumping can begin. This therefore, introduces a delay in system start-up, as it usually takes at least five to ten minutes to cool down the pump sufficiently. When an auxiliary sump is used, the sump must also be cooled down in order to prepare the system for a pumping operation. Cooling down the pump and sump is wasteful of cryogen since a quantity of the liquid is lost in the cool down procedure by boiloff. In situations where a start-up delay is unacceptable, the pump must be kept in a stand-by condition in readiness for immediate operation. The pump must therefore be kept in a cooled down state by being submerged in the cryogen, either in the primary storage tank or in an auxiliary sump, and high rates of boiloff must be tolerated. The use of auxiliary sumps is common because the heat leak through the pump into the sump is isolated from the main storage tank, and the loss of cryogen can be reduced when standby is not required by shutting off the pump/sump from the main storage tank. Nevertheless, the use of sumps represents a compromise which increases the cost and complexity of cryogenic storage systems.

A continuing need exists for a cryogenic storage system with a built-in submerged pump which can be kept in a continuously cooled down state in readiness for immediate operation, but without excessive losses of cryogen by boiloff due to heat leakage through the pump into the interior of the primary storage container, to thereby eliminate both the start-up delays as well as the loss of cryogen previously associated with the cooling down of an externally mounted pump.

SUMMARY OF THE INVENTION

The present invention is a cryogenic storage container with a built-in submerged pump which is kept in a continuously cooled down state by the cryogen stored in the tank such that pumping may be commenced immediately. The loss of cryogen through boiloff is kept to a lower figure than has been previously possible by minimizing the heat leak path from the environment into the cryogen caused by the presence of the pump inside the tank.

In general, the quantity of heat leaking into the cryogenic tank by conduction is a function of both the distance that the heat must travel from the atmosphere or the environment into the cryogen, as well as the cross section or thickness of the material through which the heat flows into the tank. Thus, the heat leak into the tank due to the presence of a submerged pump can be minimized by reducing the surface area of the pump body which comes into contact with the cryogen and also by increasing the distance between the submerged portion of the pump and the exterior of the tank. This is a difficult objective since the pump intake must be positioned near the bottom of the tank so as to pump out all of the cryogen in the tank, and yet the pump body should be accessible from the exterior of the tank so as to allow removal of the pump from the tank. To meet both objectives the pump body would have to extend through the entire cryogenic storage space such that most of the pump would be submerged in the cryogen, resulting in a large contact area and high heat leak path into the tank.

This invention overcomes these problems by providing an insulated cryogenic storage vessel with a pump mounting tube extending into the vessel and immersed in the cryogen. The outer surface of the pump mounting tube within the vessel is insulated so as to minimize the heat leakage from the pump mounting tube to the cryogen surrounding the tube. The upper end of the pump mounting tube may extend through the cryogenic vessel wall and is open at the upper end for receiving the cryogenic pump. The lower end of the pump mounting tube is also open and terminates short of the bottom of the cryogen vessel. The pump includes a pump drive head which is mounted to the upper end of the pump mounting tube exteriorly to the insulated vessel so as to seal the upper end of the pump mounting tube to the atmosphere. A pump extension tube of relatively small cross section extends through the sealed upper end of the pump mounting tube into the vessel and supports at its lower end the pump intake valve and piston assembly suspended above the bottom of the insulated vessel. The pump mounting tube is in contact with the pump drive head and also with the exterior wall of the insulated vessel and thus establishes a heat leak path into the storage vessel.

The cryogen rising into the pump mounting tube within the vessel is heated by contact with the inner surface of the pump mounting tube and with the pump extension tube. As a result, the liquid cryogen vaporizes to form a gas pocket trapped within the sealed pump mounting tube. The trapped gas will not allow additional cryogen to rise into the pump mounting tube such that in an equilibrium condition a liquid/gas interface is established near the lower end of the pump mounting tube. The gas is a poor conductor of heat and so serves to insulate the liquid cryogen from the inner surface of the pump mounting tube as well as from the pump extension tube extending within the pump mounting tube. The cryogen is thus in contact only with the lower rim of the pump mounting tube and the submerged lower end of the pump body which includes a relatively small pump/piston unit and intake valve. The length of the heat leak path into the cryogen includes the full length of the pump mounting tube and heat flowing through the pump itself must also travel nearly the full length of the pump extension tube and the pump drive shaft before coming into contact with the cryogen near the bottom of the tank. Heat leakage is further minimized by making both the pump mounting tube and the pump extension tube of thin walled tubing so as to minimize the cross section, and therefore the mass, of heat conductive material.

The inner surface of the pump mounting tube must be adequately insulated against the cryogen in the storage vessel, such as by a vacuum jacket surrounding the tube. Without such insulation the cryogen surrounding the pump mounting tube would cool the gas trapped inside the tube, causing it to condense. This would reduce the volume of gas inside the pump mounting tube and allow liquid cryogen to rise into the tube, shortening the heat leak path distance as well as increasing the area of contact of the liquid cryogen with the relatively warm inner surface of the pump mounting tube and pump extension tube. With adequate insulation around the pump mounting tube, the liquid cryogen level can be kept at the lower end of the pump mounting tube by the trapped gas. In an equilibrium condition a temperature gradient exists along the inner surface of the pump mounting tube, and pump extension tube which are at or below the cryogen boiling temperature at the bottom of the pump mounting tube and close to ambient temperature at the top of the pump mounting tube.

In a presently preferred embodiment of the invention, the cryogenic container comprises an inner shell or vessel including an inner vessel wall which is in contact with a cryogen, and an outer vessel including an outer vessel wall which is exposed to the environment. An insulation space is defined between the outer vessel wall and the inner vessel wall which may be evacuated to avoid transmission of heat by conduction or convection between the two vessels. The pump mounting tube is double-walled and includes an inner tube and an outer tube with an annular space in between. The upper end of the inner tube is attached to the outer vessel wall and is open for receiving the extension tube of a cryogenic pump. The outer tube is connected at its upper end to the inner vessel wall such that the annular space between the inner and outer tubes of the pump mounting tube communicates with the insulation space between the inner and outer vessel walls. Thus, when the insulation space is evacuated, the annular space of the double walled pump mounting tube is also evacuated and forms a vacuum jacket around the inner tube. The inner and outer tubes are preferably joined only along their lower rims so as to seal the annular space between the tubes.

The pump mounting tube preferably extends vertically into the cryogenic container through the top of the outer vessel. The upper end of the inner tube is secured to the outer vessel. The weight of the inner vessel is borne by the outer tube which in turn is supported at the lower end of the inner tube, such that the inner vessel is suspended by the pump mounting tube from the top of the outer vessel. The outer tube is thus in compression by the weight of the inner vessel while the inner tube is in tension between the outer vessel and its joint to the outer tube at the lower end. Since the relatively warm inner tube is in tension, its walls can be made relatively thin so as to minimize its thermal conduction. The outer tube being in compression requires greater wall thickness to avoid buckling under the weight of the inner vessel. This greater wall thickness does not increase the thermal conduction along the pump mounting tube however, since the outer tube is only in contact with the cold inner vessel and the cold lower end of the inner tube and is insulated from the inner tube by a vacuum jacket. Given that all or a substantial portion of the weight of the inner vessel can be thus suspended, little additional support is required between the two vessels which is a desirable objective in order to minimize heat leak paths through such internal supports.

These and other characteristics of the present invention are better understood by reviewing the following figures which are submitted for the purposes of illustration only and not limitation, wherein like elements are referenced by like numerals in light of the detailed description of the prefered embodiment.

BRIEF DESCRIPTION OF THE DRAWINGS

FIG. 2 is a cross section taken along line 2—2 in FIG. 1.

FIG. 3 is a longitudinal section of the pump mounting tube of the cryogenic tank of FIG. 1, the pump mounting flange being shown in alignment with the pump mounting tube.

DETAILED DESCRIPTION OF THE PREFERRED EMBODIMENT

Figure 1:
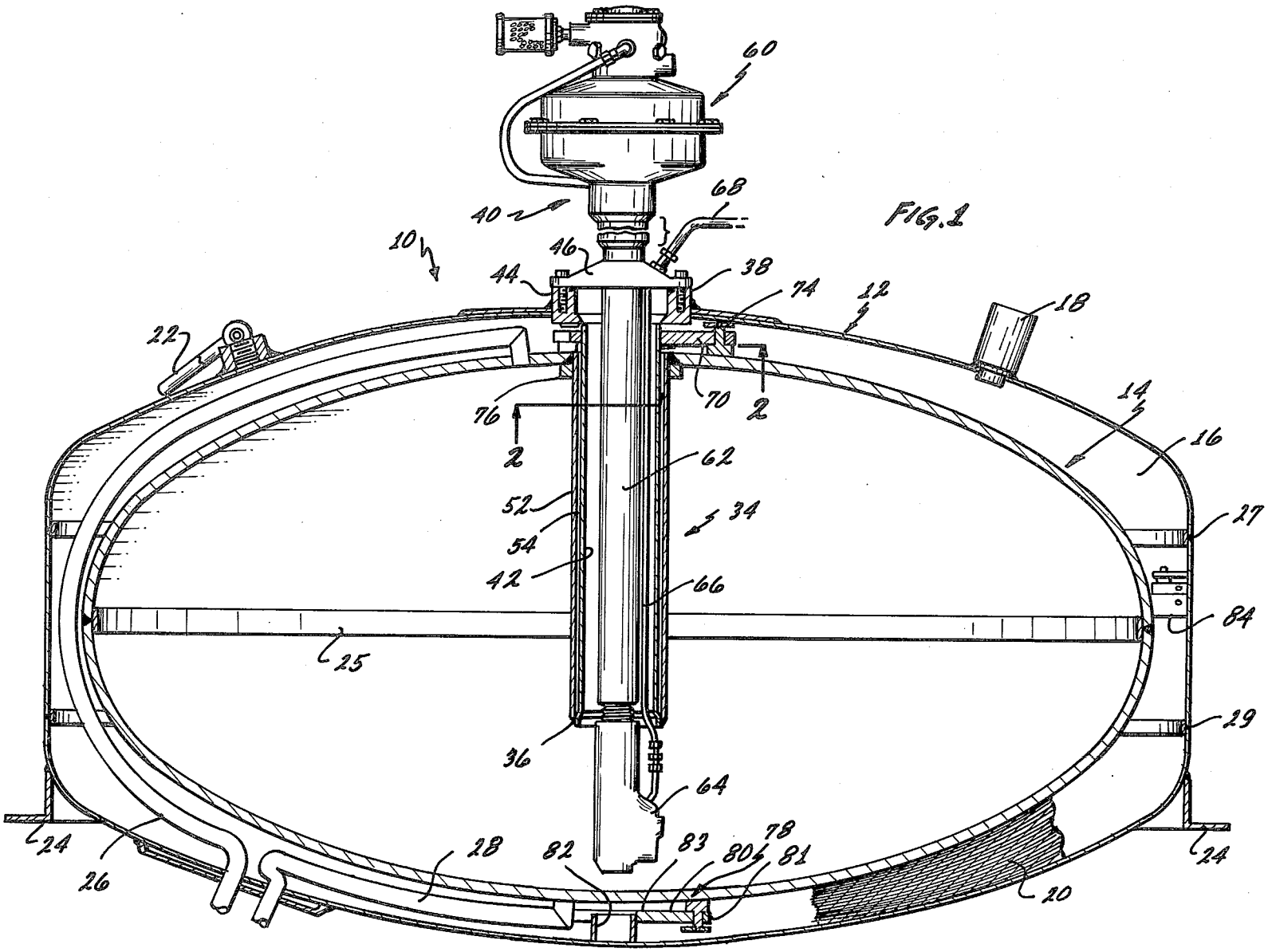
FIG. 1 is an elevational cross section of the novel cryogenic tank with built-in submerged pump.

With reference to FIG. 1, a cryogenic tank 10 includes an outer vessel 12 which encloses an inner vessel 14. The outer vessel wall is spaced from the inner vessel wall so as to define an insulation space 16 surrounding the inner vessel. The outer shell 12 is provided with an evacuation valve 18 through which the air in the insulation space may be evacuated so as to create a vacuum in the space 16 and thereby prevent heat flow into the inner vessel by conduction or convection. The inner vessel is also wrapped in a reflecting material such as aluminized mylar which prevents the transfer of thermal energy by radiation. The radiation barrier may consist of a multi-layered blanket 20 consisting of forty sheets of one fourth ($\frac{1}{4}$) mil aluminized mylar which has been crinkled so that adjacent sheets are spaced from each other by the irregular ridges of the crinkled surfaces. The crinkling reduces the area of contact between sheets and establishes relatively long heat flow paths through the multi-layer blanket, thus minimizing conduction of heat through the mylar material. While only a fragment of the insulating blanket 20 is illustrated in FIG. 1, it will be understood that the entire inner tank is covered by such a blanket within the insulation space 16.

A pump mounting tube 34 extends vertically through the top of both the outer vessel 12 and inner vessel 14 and is aligned with the vertical axis of the tank assembly. The pump mounting tube 34 is open at its lower end 36 to the interior of the inner vessel 14 and is also open at its upper end 38 for admitting a pump extension tube/drive shaft 62.

As better understood by reference to FIGS. 2 and 3, the pump mounting tube 34 is double walled and comprises an inner tube 42 and an outer tube 52. The inner pump tube 42 is attached at its upper end to the outer vessel 12, as by welding. The upper end of the inner tube 42 includes a flange 44 to which is fastened the mounting flange 46 of a cryogenic pump 40. The mounting flange 46 is provided with a number of mounting bolts 48 which thread into corresponding bores 49 in thee tube flange 44. Both the pump flange 46 and tube flange 44 may be provided with circular grooves 47 for seating a resilient O-ring 50 to ensure a gas-tight seal at the upper end 38 of the pump mounting tube 34 when the pump flange 46 is mounted to the tube flange 44.

The lower ends of the inner tube 42 and outer tube 52 are joined in an air tight seal 36 achieved e.g. by welding together the lower rims of the coaxial tubes 42 and 52. The upper end 55 of the outer tube 52 is connected also as by welding to the wall of the inner vessel 14. The inside diameter of the outer tube 52 is somewhat greater than the outside diameter of the inner tube 42 so as to define a jacket space 54 between the two tubes. This jacket space is open at the top of the outer tube 52 and is thus in communication with the insulation space 16 between the outer vessel 12 and the inner vessel 14. As the insulation space 16 is evacuated, the jacket space 54 between the inner and outer tubes is also evacuated and forms an insulating vacuum jacket around the inner tube 42.

The upper end of the inner tube 42 is in thermal contact with the outer vessel wall 12 and a temperature gradient is therefore established along the inner tube which ranges from close to ambient temperature near the flange 44 at the top of the tube down to the boiling point of the cryogen at the lower end 36 of the pump mounting tube 34. The outer tube 52 is submerged in the cryogen and is in thermal contact at its upper end only with the inner vessel wall 14 which is, of course, near cryogen temperature. The only contact between the inner and outer tubes occurs at their joint lower rims 36.

The cryogenic pump includes a pump drive head 60 which is external to the cryogenic tank and thus readily accessible for repair or maintenance. A pump extension tube 62 extends downwardly from the drive head 60 and supports at its lower end a pump piston and intake valve unit 64. The pump piston is reciprocated by a drive shaft enclosed in the extension tube 62 and not visible in the drawings. The length of the pump extension tube 62 is such that the pump piston and intake valve unit 64 is suspended near the bottom of the inner vessel 14 so as to draw in cryogen from the bottom of the vessel. A pump output tube 66 extends upwardly from the cryogen intake unit 64 through the inner pump mounting tube 42 adjacent to the pump extension tube 62, passes through the pump mounting flange 46 and terminates in an external cryogen discharge port 68 which delivers the cryogen output of the pump 40.

When the inner vessel 14 of the cryogenic tank is initially filled with cryogen, the liquid tends to rise into the inner tube 42. However, as was earlier explained, this tube is relatively warm so that some of the cryogen within the pump mounting tube vaporizes. The upper end of the tube 42 is sealed by the pump flange 46 so that a pocket of trapped gas is formed in tube 42. An equibrilium condition will be reached in which the entire interior of the pump mounting tube is filled with a pocket of gas which prevents additional cryogen from entering the tube. As a result, a gas liquid interface is established near the lower end 36 of the pump mounting tube 34. The gas within the pump mounting tube is a poor conductor of heat and thus serves to effectively insulate the cryogen at the bottom of the pump mounting tube. The inner tube 42 is insulated from the liquid cryogen filling the vessel 14 by means of the vacuum jacket defined by the outer tube 52 in order to prevent cooling of the inner tube 42 along its entire length. Such cooling would occur if the inner tube 42 were immersed directly in cryogen and would sufficiently lower the temperature of the inner surface of the inner tube 42 to cause condensation of the trapped gas. This would reduce the volume of the gas pocket and allow liquid cryogen to rise into the pump mounting tube 34, thereby shortening the length of the thermal path established by the inner tube 42 as well as increasing the area of the cryogenic pump in direct contact with the liquid cryogen. The pump mounting tube 34 also serves to insulate the pump extension tube 62 against contact with the liquid cryogen since the portion of the pump extension tube within the pump mounting tube extends through the trapped gas pocket. Only the lowermost portion 64 of the cryogenic pump is actually in contact with the cryogen.

The length of the pump mounting tube 34 is made as long as possible in order to extend the thermal path established by the inner pump mounting tube 42. The wall of the inner tube 42 is made as thin as possible, e.g. of 0.065 inch stainless steel tubing, in order to minimize the cross section of the thermal path established by the inner pump mounting tube and minimize conduction of heat to the lower end 36 of the pump mounting tube. The outer tube 52 may be made of thicker walled tubing since it is not in thermal contact with the exterior environment. The inner surface of tube 52 and the outer surface of tube 42 are desirably highly polished in order to improve the thermal insulation characteristics of the vacuum jacket defined between the two tubes.

The thickness of the tubing used for the pump extension tube 62 and drive shaft is also kept to a minimum so as to minimize the cross section of the thermal path established thereby. Very thin materials can be used for the pump extension tube since it is in tension and only supports the relatively small weight of the piston and intake unit 64.

Preferably, the inner tube 42 is stabilized relative to the outer tube 52 and inner vessel 14 by means of an insulating spider 70 which includes a collar 72 encircling the inner tube 42 below the flange 44 and three or more radial arms 73, extending from the collar 70 and secured at their outer ends to the inner vessel 14 by means of suitable fasteners 74. The insulating spider may be made of a material such as laminated plastic having good thermal insulating properties in order to avoid heat leakage from the relatively warm upper end of the inner pump mounting tube 42 to the cold inner vessel wall 14.

A further improvement in efficiency of the cryogenic tank is realized by using the double walled pump mounting tube 34 to support the inner vessel 14 in spaced relationship to the outer vessel 12. The flange 44 at the upper end of the inner tube 42 is secured as by welding to the wall of the outer vessel 12, and the upper end 55 of the outer tube 52 is secured to the rim of a suitably sized opening 57 in the top of the inner vessel 14. The joint between the upper end of the outer tube 52 and the inner vessel 14 may be reinforced by means of an annular corner brace 76 welded to both the outer tube 52 and the inside surface of the inner vessel wall 14 as best illustrated in FIG. 3. Assuming no other support for the inner vessel 14, it will be appreciated that the weight of the inner vessel bears down on the upper end of the outer tube 52 which transmits the weight to the joint 36 between the inner and outer tubes at their common lower end. The inner vessel 14 and outer tube 52 in turn are suspended from the top of the outer vessel 12 by the inner tube 42. In this arrangement, the outer tube 52 is in a state of compression under the weight of the inner vessel 14, while the inner tube 42 is in a state of tension because the weight of the inner vessel 14 depends from the lower end of the inner tube. Since the tube 42 is in tension, it is possible to maintain the wall thickness of the inner tube 42 relatively thin so as to minimize the cross section of the thermal path along this tube, without compromising the strength of the tube wall required for supporting the weight of the relatively heavy inner vessel 14. The outer tube 52 however, is in comression and is thus made of a thicker walled tubing to prevent buckling under the weight of the inner vessel 14.

Preferably, the inner vessel 14 is supported at two additional points against rotation and oscillation, respectively, relative to the outer vessel 12. For example, a bottom support 78 may include a second insulating spider 80 which has a number of radial arms fastened at their outer ends 81 to the bottom of the inner vessel 14 and an apertured center portion 83 which receives a tubular stub 82 mounted to the bottom of the outer vessel 12. The inner vessel 14 is thus kept from oscillating within the outer vessel 12 as would occur if the inner vessel were simply suspended by means of the pump mounting tube 34. The inner vessel can be further restrained against rotation within the outer vessel 12 by means of an insulating side support 84. As the entire weight of the inner vessel can be suspended from the outer vessel 12 by means of the pump mounting tube 34, the bottom support 78 and side support 84 can be made of relatively light materials such as laminated plastics which have good thermal insulation properties.

The inner vessel 14 may be formed by welding together along a seam 25 two elliptical end portions having a major ellipse axis which is two times the length of the minor ellipse axis in a vertical plane. In a horizontal plane the cryogenic tank may be circular. The outer shell may be made by welding a straight cylindrical middle portion between dished top and bottom portions along seams 27 and 29, respectively. The outer vessel 12 may be made of relatively thin sheet metal sufficiently rigid for supporting the combined weight of the inner tank and the stored cryogen. The inner vessel 14, however, will normally be made of thicker gauge plate in order to withstand the internal pressures of the cryogen. The insulation space 16 may be approximately one to two inches in width between the inner and outer vessels at the equator of the tank and will normally be evacuated to one micron of mercury. In addition to or in lieu of the radiation shield formed by the reflecting blanket 20, the insulation space 16 may be filled with a radiation inhibiting powder such as the material commercially known as Pearlite. In this case, the width of the insulation space may have to be increased to approximately six to eight inches.

The pump drive head 60 may be of the gas driven type known in the art which may be driven by the boiloff gases of the cryogenic storage tank itself through suitable conduits.

The outer tank 12 can be further provided with one or more lifting rings 22 affixed to the upper surface of the outer tank. A circular base flange 24 is welded about the lower end of the outer tank 12. The flange 24 supports the tank 12 when it is mounted on a platform provided with an opening for receiving the bottom of the cryogenic tank such that the base flange 24 rests on the platform and the cryogenic tank is supported above or within the opening in the base. The insulated tank 10 can be further provided with a gas phase fill tube 26 and a liquid phase fill tube 28 connected to the top and bottom respectively of the inner tank 14 and extending through the insulation space 16 to the exterior of the cryogenic tank. The tank is further provided with suitable instrument and full trycock tubes and other conduits leading into the inner vessel 14 as may be needed and are known in the art.

It must be understood that many alterations and modifications can be made by those having ordinary skill in the art to the structure of the present invention without departing from the spirit and scope of the invention. Therefore the presently illustrated embodiment has been shown only by way of example and for the purpose of clarity and should not be taken to limit the scope of the following claims.

I claim:

1. A low boil-off cryogenic tank for use with a built-in pump comprising:

an insulated vessel; and a pump mounting tube extending through the wall of said insulated vessel, said pump mounting tube having an inner surface thermally insulated from the outer surface of the tube and from the vessel walls contacting cryogen stored within said vessel, said tube having an open lower end, the upper end of said tube including means adapted to make a gas tight seal with a pump mounted thereto and extending through said tube and into said vessel.

2. The cryogenic tank of claim 1 further comprising a cryogenic pump extending into said vessel through the interior of said pump mounting tube, said pump including a pump drive head mounted to the upper end of the pump mounting tube said drive head also being thermally insulated from the outer surface of said pump mounting tube and vessel walls in contact with cryogen stored therein, said pump drive head making a gas tight seal with the upper end of said pump mounting tube so as to trap a pocket of vaporized cryogen within said tube and prevent liquid cryogen from rising into the pump mounting tube.

3. The cryogen tank of claim 1 wherein said cryogenic pump further comprises a pump extension tube extending into said vessel from said drive head and spaced from the inner surface of said pump mounting tube.

4. A cryogenic storage tank with a built-in pump comprising an outer vessel, an inner vessel and an insulation space therebetween, an outer tube within said inner vessel connected at its upper end to said inner vessel, an inner tube within said outer tube connected at its upper end to said outer vessel, said outer and inner tubes being joined at their lower rims to define an annular space between said inner and outer tubes communicating with said insulation space, the inner tube thus being in thermal contact with the relatively warm outer vessel and the outer tube being in thermal contact with the cryogen cooled inner vessel connected to said inner tube at its lower end.

5. The cryogenic tank of claim 4 further comprising a pump drive head mounted to said inner tube to make a gas tight seal, a pump extension tube extending through said inner tube and a pump intake assembly supported by said extension tube within said inner vessel.

6. The cryogenic tank of claim 4 wherein said inner vessel is suspended from said outer vessel by said outer and inner tubes connected at their lower ends, said outer tube being in compression while said inner tube is in tension such that said inner tube may be thin walled relative to said outer tube to minimize thermal flow into said inner vessel.

7. The cryogenic tank of claim 4 wherein said insulation space and said communicating annular space are evacuated to create a vacuum jacket about said inner tube and said inner vessel.

8. The cryogenic tank of claim 7 further comprising thermal radiation barrier means disposed within said insulation space.

9. The cryogenic tank of claim 4 further comprising means supporting said inner vessel against rotation and oscillation relative to said outer vessel.

10. The cryogenic tank of claim 4 further comprising thermally insulating support means supporting the upper end of said inner tube against radial displacement within said outer tube.

11. The cryogenic tank of claim 5 wherein said cryogenic pump is provided with mounting means including means for sealing the upper end of said pump mounting tube.

12. A cryogenic storage tank with a built-in pump comprising an insulated vessel, a pump mounting tube extending vertically through the wall of said insulated vessel and having an open lower end, said pump mounting tube having an inner surface thermally insulated from the vessel wall in contact with cryogen stored in said vessel and the outer surface of the pump mounting tube, and a cryogenic pump extending into said vessel through said pump mounting tube said pump having a cryogen intake disposed below said lower end of the mounting tube, said pump mounting tube being closed at its upper end so as to contain a pocket of vaporized cryogen in its interior.

* * * * *